US006062162A

United States Patent [19]

Dean

[11] Patent Number: 6,062,162

[45] Date of Patent: May 16, 2000

[54] PROTECTIVE GARAGE MAT WITH PARKING ALIGNMENT DEVICE

[76] Inventor: Lance Leo Dean, 808 Mayfair Hill Ct., Bedford, Tex. 76021

[21] Appl. No.: 09/183,309

[22] Filed: Oct. 30, 1998

[51] Int. Cl.[7] ..... G09F 17/00; B65D 1/34

[52] U.S. Cl. ..... 116/28 R; 116/173; 33/264; 40/608; 220/573

[58] Field of Search ..... 116/28 R, 173–175, 116/203, 205; 33/264; 40/606, 607, 608; 340/932.2; 296/38; 220/573; 184/106; 222/108; 180/69.1; 188/32

[56] References Cited

U.S. PATENT DOCUMENTS

| | | | |
|---|---|---|---|
| 1,267,021 | 5/1918 | Watts | 116/63 P |
| 2,746,571 | 5/1956 | Taylor | 188/32 |
| 3,016,035 | 1/1962 | Asbury | 116/173 |
| 3,121,416 | 2/1964 | Gizdich | 116/28 R |
| 3,368,518 | 2/1968 | Anthony | 116/173 |
| 3,792,679 | 2/1974 | Duckett et al. | 116/63 P |
| 4,433,636 | 2/1984 | Crouch | 116/28 R |
| 4,965,571 | 10/1990 | Jones . | |
| 5,227,785 | 7/1993 | Gann et al. . | |
| 5,231,392 | 7/1993 | Gust | 116/28 R |
| 5,266,378 | 11/1993 | Stephenson . | |
| 5,462,004 | 10/1995 | McGlothin | 116/173 |
| 5,478,625 | 12/1995 | Wright | 180/69.1 |
| 5,547,312 | 8/1996 | Schmitz, Jr. | 220/573 |

*Primary Examiner*—Andrew H. Hirshfeld
*Attorney, Agent, or Firm*—Law Offices of Royal W. Craig

[57] ABSTRACT

A protective garage mat with integral parking alignment device for protecting a surface from oil spills while concurrently providing vehicle parking assistance. The floor mat includes a reinforced rubber mat having ribs/channels for retaining a pre-determined quantity of oil. The floor mat is formed with a coupling at the fore end for mounting a parking alignment indicator such as an upright pole having a reflector or signal light mounted thereon. The pole is supported in the mat by the coupling for pivotal movement upon being contacted by an advancing vehicle. An optional electrical circuit may electrically actuate a signal light to provide a visible alerting signal for a driver of the advancing vehicle.

9 Claims, 6 Drawing Sheets

PROTECTIVE GARAGE MAT WITH PARKING ALIGNMENT DEVICE

BACKGROUND OF THE INVENTION

1. Field of the Invention

The present invention relates to garage mats for protecting garage floors against drippage of automobile oil, anti-freeze, brake, and other fluids and, more particularly, to a protective garage mat with integral parking alignment device to assist in auto parking.

2. Description of the Background

The general concept of providing a visual indicator for informing a vehicle operator that they have reached an optimal or safe parking position is well-known in the prior art. Such devices utilize a variety of mechanisms including pressure switches for triggering indicator lights, mirrors, light projecting systems, etc.

For example, U.S. Pat. No. 4,965,571 to Jones discloses a parking guide in which the vehicle bumper engages a mechanical arm which extends downward from an indicator. As the arm rotates under the force of the car's bumper, the indicator light shuts off, informing the driver that they have reached the desired parking location.

U.S. Pat. No. 5,227,785 to Gann discloses a freestanding parking apparatus including a hollow mounting base, an upright pole having a signal light mounted thereon, supported on the base for pivotal movement from a normal upright non-signaling position to a tilted signaling position upon being contacted by an advancing vehicle. An electrical circuit connected to the signal light actuates the signal light to provide a visible alerting signal for a driver.

Likewise, there are a number of commercially available floor mats for placement under vehicles to protect against spillage of oil, anti-freeze, brake, and other fluids.

However, there have been relatively few efforts to combine the two above-described concepts in a combination protective garage mat with integral parking alignment device.

U.S. Pat. No. 5,266,378 to Stephenson shows a "Wheel positioning garage mat" including a substantially rectangular mat, with an upper surface having forward and rearward transverse bumps formed integrally thereon to indicate a desired parking position for the vehicle.

However, in this patent and its progeny, the bumps serve as chocks for the wheels of the vehicle, and the proper parking position is arrived at by the "feel" of the chocks. Unfortunately, the feel of the chocks is often difficult to detect, especially in a cluttered garage.

It would be greatly advantageous top provide a protective garage mat with integral parking alignment device that incorporates a visual parking indicator in a floor mat, the visual indicator activated by contact with a bumper of the vehicle to actuate a visual and/or audible signal to apprise the driver of his progress.

SUMMARY OF THE INVENTION

It is, therefore, an object of the present invention to provide a protective garage mat with parking alignment device that uses a visual indicator to give an unmistakable visual indication of the proper parking position.

It is another object to incorporate an parking position indicator in a floor mat, the indicator being activated by contact with a bumper of the vehicle to actuate a visual and/or audible signal to apprise the driver of his progress.

It is still another object to provide a parking position indication by means of a reflective sign or brightly colored ball supported on a shaft at the fore end of the mat, and by an audible signal such as an electronic tone, the shaft being pivotable to indicate bumper contact by deflection and by the tone.

It is another object to provide a floor mat/parking indicator capable of catching and confining at least one full quart of oil, anti-freeze, brake, and other fluid.

It is another object to provide a floor mat/parking indicator as described above that can be rolled lengthwise in a semi-circle and placed in a freestanding position (or inside a storage/cleaning tube) for convenient drainage of oil or cleaning.

It is still another object to provide a floor mat/parking indicator with a rounded leading edge to prevent vehicles from running up over its edges while parking.

According to the present invention, the above-described and other objects are accomplished by providing a combination under-vehicle floor mat and parking guide for assisting the driver of a vehicle to park in a desired position. The floor mat/parking guide includes a mat section formed of flexible material such as rubber. The mat section has a raised peripheral margin and a plurality of parallel ribs formed along its upper extent. The ribs intersect the margin to form a plurality of recesses to retain spilled fluid. A plurality of interstitial ribs exist in the recesses between the peripheral margin and parallel ribs to retain fluid by capillary action.

A parking indicator is insertable into the mat section, and the parking indicator includes a resilient elongate shaft with a visual indicator mounted on its distal end. Optional illuminated and/or audible warning signals may also be provided. To anchor the parking indicator shaft in the mat section, a coupling is incorporated in the mat section. The coupling includes a recess for receiving the inserted end of the shaft and thereby maintaining the parking indicator in a substantially upright position. The mat and rubber collar have sufficient elasticity to allow the parking indicator to pivot when contacted by an advancing automobile.

The coupling may include a ring suspended by a plurality of integrally-molded struts, or alternatively, a T-insert having a stem for upward insertion through said mat section and a base for anchorage beneath the mat section.

The garage mat/parking alignment device gives an unmistakable visual indication of the proper parking position upon contact with a bumper of the vehicle. Moreover, the floor mat/parking indicator is capable of catching and confining at least one full quart of oil, antifreeze, brake, and other fluids oil.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The protective garage mat with parking alignment device of the present invention may be quickly unrolled, assembled and deployed in a garage and, when not in use, may be conveniently rolled, carried and stored. The particular structural design described herein (including dimensions and fit of the various cooperating parts) result in a mat that is capable of containing a large volume of oil or other liquid for protecting garage floors, plus an integral parking alignment device to assist in auto parking. The end product is rugged and durable for long-time use, and the design lends itself to economical manufacture.

Figure 1:
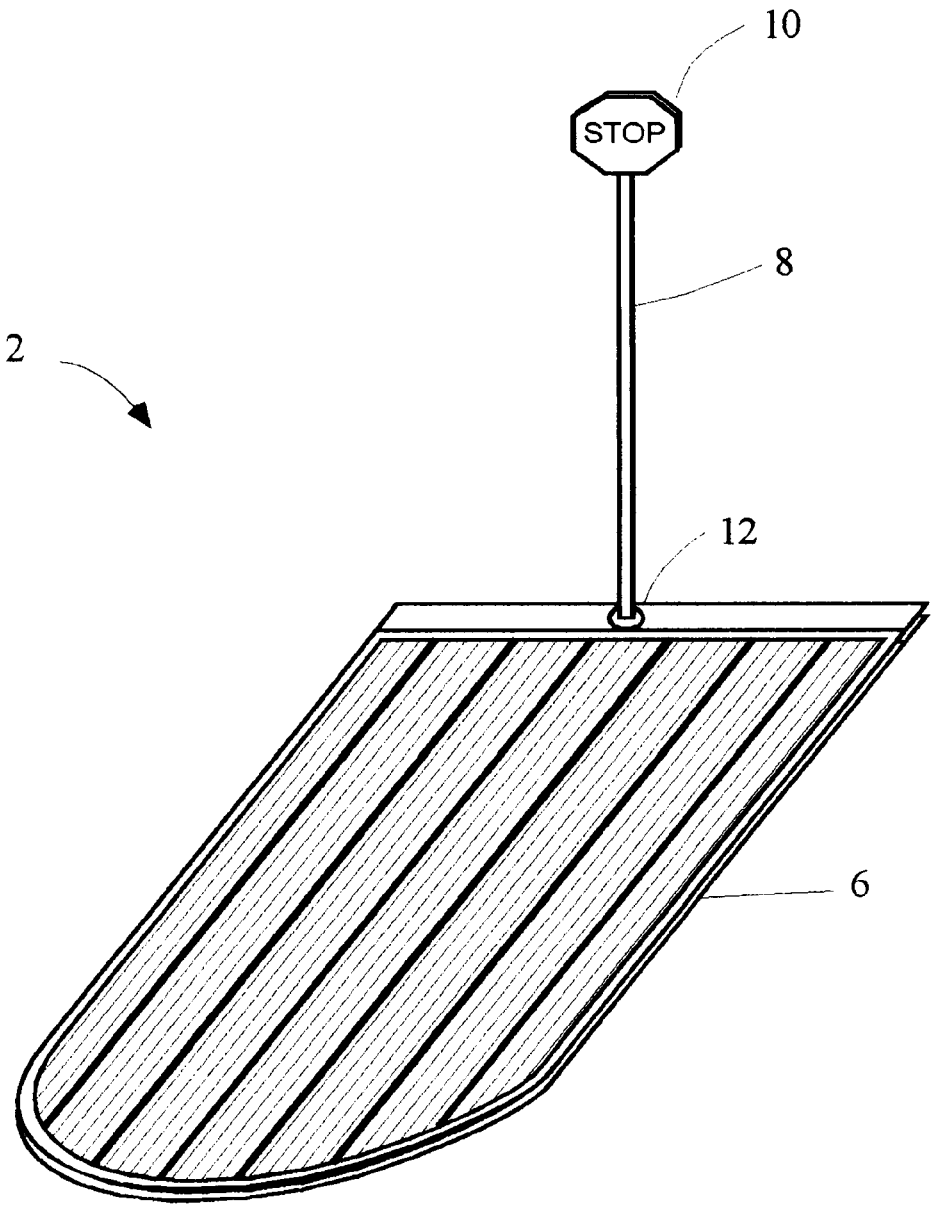
FIG. 1 is a perspective view of a protective garage mat with parking alignment device according to one embodiment of the present invention.

FIG. 1 is a perspective view of a combination protective garage mat/parking alignment device 2 according to one embodiment of the present invention.

The mat/alignment device 2 generally includes a rubber mat section 6 having a back end and a fore end, and a pivoting shaft 8 mounted in the fore end of mat section 6 to assist in automobile parking. A reflective sign 10 is supported on shaft 8 at the fore end of the mat section 6. Shaft 8 is pivotally anchored within mat section 6 by means of a collar coupling 12 as will be described. Shaft 8 may be a simple wood or fiberglass dowel, and it preferably includes at least two telescoping sections to make it extensible. It is important that shaft 8 have a high degree of flexibility so that the automobile bumper cannot back the shaft out of the mat section 6 during parking. The telescoping sections may be locked at a desired length by a conventional set screw, and this allows adjustment of the length of shaft 8 to accommodate the bumper height of various automobile makes and models.

Figure 2:
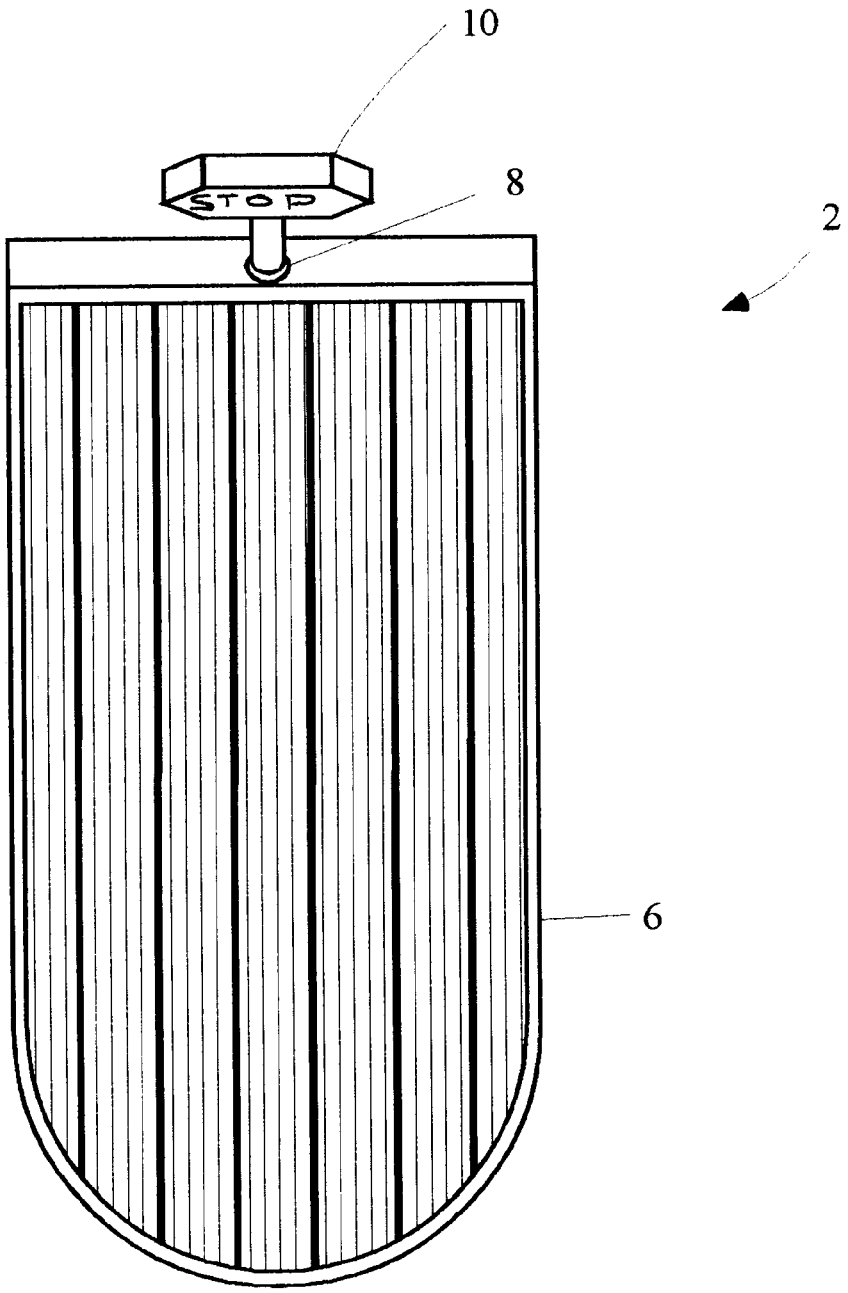
FIG. 2 is a top perspective view of the protective garage mat with parking alignment device as in FIG. 1.
Figure 3:
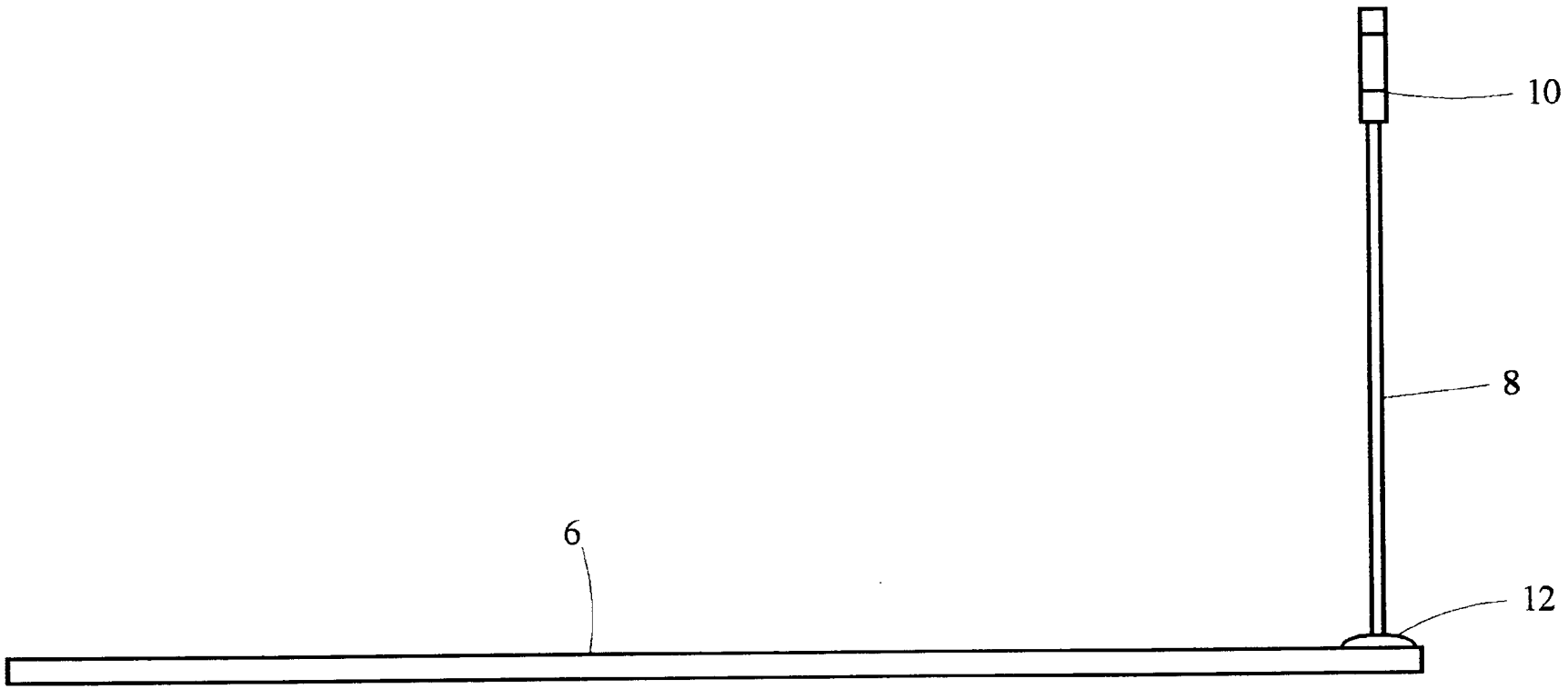
FIG. 3 is a side view of the protective garage mat with parking alignment device as in FIGS. 1 and 2.

FIGS. 2 and 3 are a top perspective view and side view, respectively, of the protective garage mat/parking alignment device 2 as in FIG. 1. Mat section 6 employs a rugged, heavy-weight design and is preferably molded of 100% rubber or poly vinyl chloride (PVC). As will be described, mat section 6 is molded with deep ribs and channels across the upper surface to trap oil and dirt and to help keep the floor cleaner. Mat section 6 is preferably formed or cut in a semi-oblong shape with a rounded back end and a squared fore end. This configuration is aesthetically pleasing and lends itself to economical manufacture. The rounded back end has additional advantages, making it easier to roll up and pack the mat section 6 and helping to prevent vehicles from running up over the edges while parking.

As will be described, it is significant for purposes of the present invention that the protective garage mat/parking alignment device 2 can be rolled lengthwise in a semicircular configuration for placement in a freestanding position (or inside a storage/cleaning tube). This facilitates convenient drainage of oil or cleaning.

The mat section 6 with ribs can be extrusion-molded and cut to the desired shape, and a narrow cross-section incorporating collar-coupling 12 (for mounting the reflective sign 10 on shaft 8) can be molded separately and seam-welded to the mat section 6.

Preferably, mat section 6 is given a grime-hiding brown color to preserve the clean appearance of a garage or workplace. This way, mat section 6 is easy to clean, just by hosing off.

Figure 4:
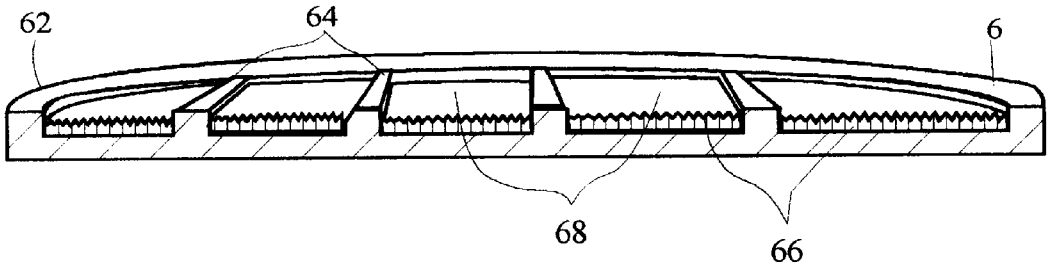
FIG. 4 is a front cross-sectional view of the garage mat section 6 illustrating the corrugated rib configuration for containing oil spills.

FIG. 4 is a front cross-sectional view of the garage mat section 6 illustrating the corrugated rib configuration for containing oil spills. Mat section 6 is bounded by a raised periphery 62 and is further sectioned by longitudinal ribs 64 which intersect periphery 62. This effectively makes the mat section 6 a shallow containment basin that is subdivided by a number of independent recesses for oil containment. In this manner, mat section 6 is capable of holding a significant volume of spilled oil or other fluid.

Moreover, the deep ribbed design makes it possible to cover mat section 6 with sorbent materials such as those commercially available from 3M™. Such materials typically absorb oil and other target liquids, thus protecting against further contamination of the surrounding environment and preventing against liquid leaching once it is encapsulated. The requisite amount of sorbent material may be spread atop mat section 6 and is contained therein by the ribs 62, 64.

Smaller interstitial ribs 66 are formed between the longitudinal ribs 64. The interstitial ribs 66 work by capillary action to keep oil and fluids trapped within mat section 6, and they also provide a slip-resistant walking surface. Interstitial ribs 66 may be integrally molded as part of mat section 6, or they may be formed as separate insets for subsequent adhesion thereto.

Figure 5:
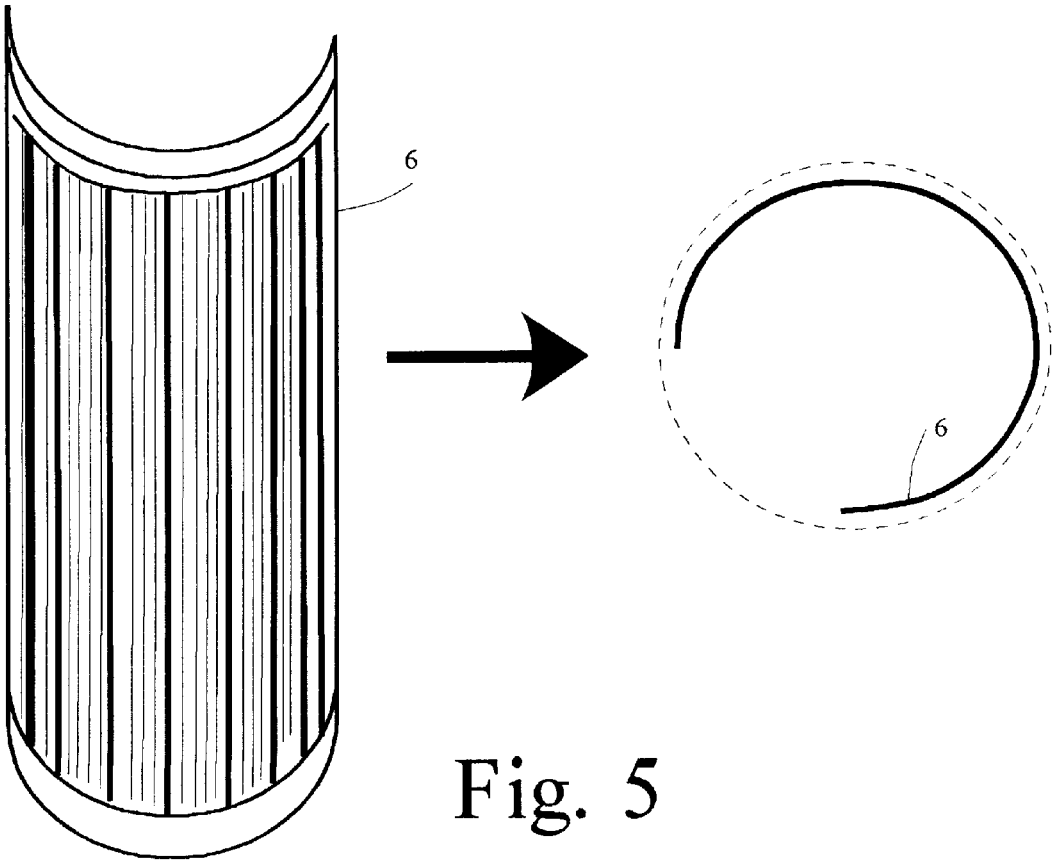
FIG. 5 is a side perspective view of the protective garage mat with parking alignment device as in FIGS. 1–3 in its rolled freestanding position for convenient drainage of oil and cleaning.

FIG. 5 is a side perspective view of the protective garage mat with parking alignment device as in FIGS. 1–3 in a rolled freestanding position for convenient drainage of oil and cleaning. The protective garage mat/parking alignment device 2 is rolled lengthwise in a semicircular configuration. Generally, the weight of the garage mat/parking alignment device 2 is sufficient to retain a rolled freestanding position. However, to keep the position through cleaning and spraying under pressure the rolled mat/parking alignment device 2 can be inserted into a storage/cleaning tube as shown at right. The tube may be a wire mesh to facilitate cleaning.

Figure 6:
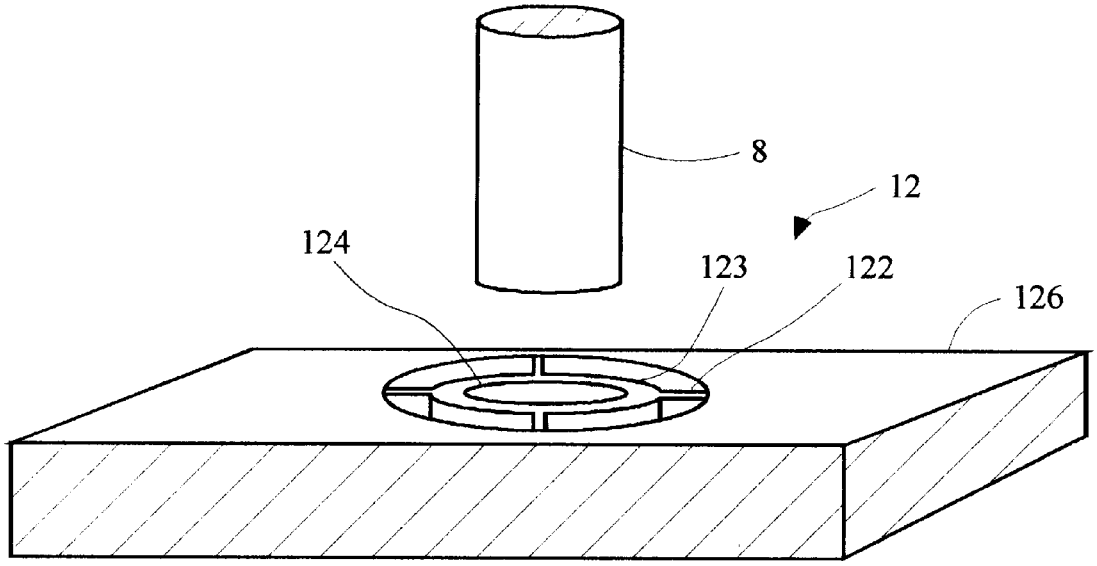
FIG. 6 is a perspective drawing of the collar-coupling 12 as shown in FIGS. 1–3.

FIG. 6 is a perspective drawing of the collar-coupling 12 as shown in FIGS. 1–3. The coupling 12 embodiment of FIG. 6 incorporates a narrow cross-section of rubber 126 which must be attached separately to mat section 6 such as by seam-welding or the like. This is because the collar coupling 12 cannot be extruded. The collar coupling 12 is formed as a ring 123 that is suspended from cross-section 126 by a plurality of integrally-molded struts 122. The struts 122, being themselves resilient, allow ring 123 to pivot. Thus, when shaft 8 is anchored therein (by a compression fit within hole 124), the shaft 8 is free to pivot.

Figure 7:
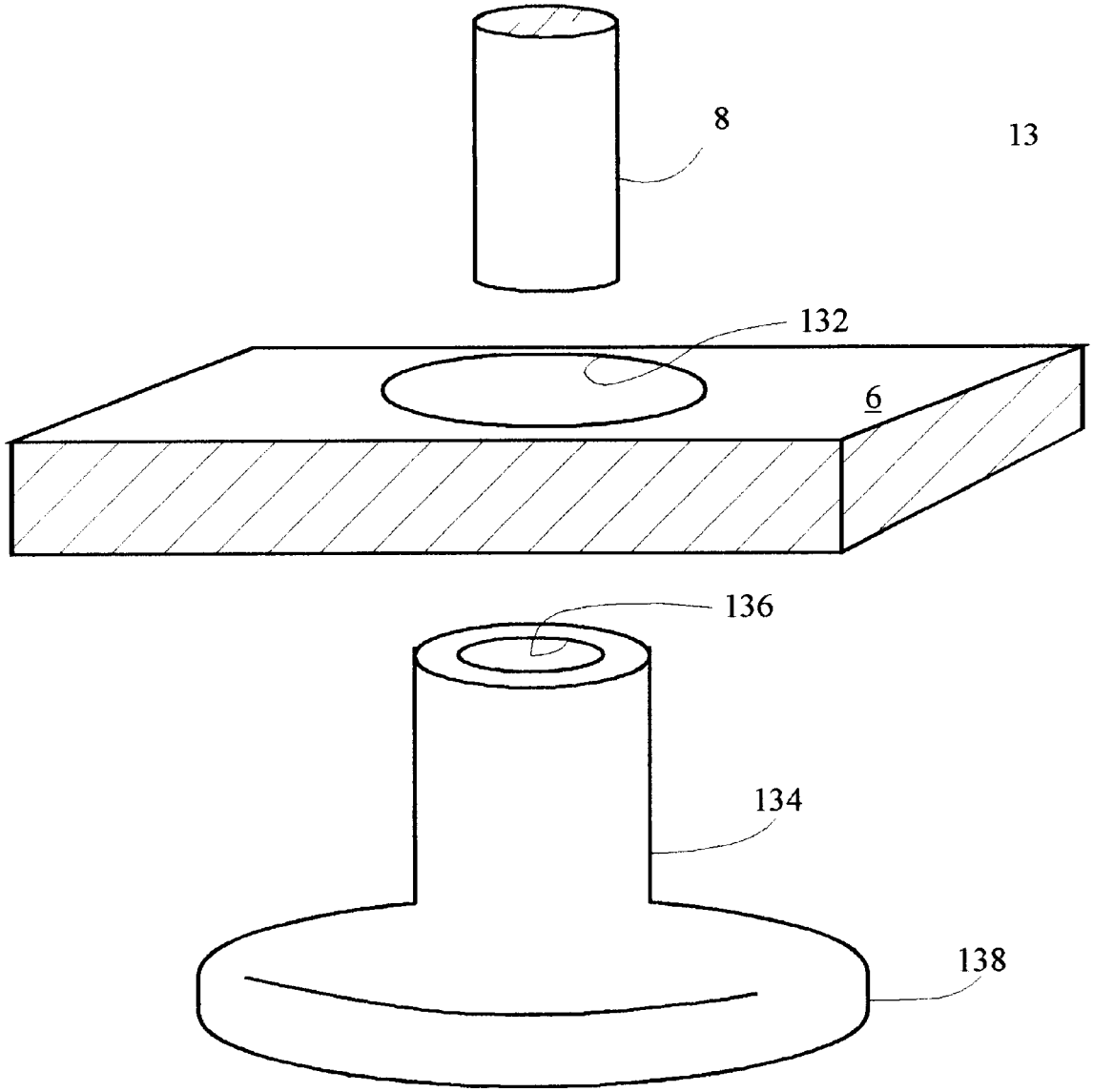
FIG. 7 is a perspective drawing of an alternative collar-coupling 13 that can be incorporated directly into an extrusion-molded mat section 6.

As an alternative to collar coupling 12, FIG. 7 is a perspective drawing of a collar-coupling 13 that can be incorporated directly into an extrusion-molded mat section 6. For this purpose, a hole 132 is formed through mat section 6. The collar coupling comprises a rubber T-insert having a stem 134 that extends upward through mat section 6, and a base 138 that is anchored beneath the mat section 6. The hollow stem 134 forms a receptacle by which shaft 8 can be inserted and anchored in hole 136. Again, when shaft 8 is anchored therein (by a compression fit within hole 136), the shaft 8 is free to pivot.

An optional electrical circuit may electrically actuate an audible signal or signal light to provide a visible/audible alert to the driver of the advancing vehicle.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A combination under-vehicle floor mat and parking guide for assisting the driver of a vehicle to park in a desired position, comprising:

a mat section formed of flexible material and including a raised peripheral margin and a plurality of parallel ribs formed along the upper extent, said ribs intersecting said margin to form a plurality of recesses to retain fluid spilled thereon;

a parking indicator including a resilient elongate shaft having a visual indicator mounted on one end; and a coupling in a forward central area of said mat section for receiving said parking indicator, said coupling including a collar for receiving the other end of said shaft and thereby maintaining said parking indicator in a substantially upright position when inserted therein, said forward central area of said mat section having an aperture having an aperture therethrough, said aperture surrounding said collar with clearance around the perimeter of said collar, said coupling further including a flexible support member connecting said collar to in said mat section, said flexible support member having sufficient elasticity to allow said parking indicator to pivot within said aperture when contacted by an advancing automobile.

2. The combination under-vehicle floor mat and parking guide according to claim 1, wherein said flexible support member is a plurality of integrally-molded struts that suspend said collar within the aperture.

3. The combination under-vehicle floor mat and parking guide according to claim 1, wherein said collar and flexible support member are integrally formed as a T-insert for insertion through said mat section, said flexible support member being a base for anchorage beneath the mat section.

4. The combination under-vehicle floor mat and parking guide according to claim 1, wherein said mat section further comprises a plurality of interstitial ribs between said peripheral margin and parallel ribs to retain oil and fluid by capillary action.

5. The combination under-vehicle floor mat and parking guide according to claim 4, wherein said mat section is adapted to be rolled lengthwise along said parallel ribs into a semi-circular configuration for placement in a freestanding position during drainage of oil and cleaning.

6. The combination under-vehicle floor mat and parking guide according to claim 5, wherein said mat section, when rolled, may be inserted lengthwise into a retaining tube during drainage of oil and cleaning.

7. The combination under-vehicle floor mat and parking guide according to claim 1, wherein said mat section is formed of rubber.

8. The combination under-vehicle floor mat and parking guide according to claim 1, wherein said mat section is formed of poly vinyl chloride (PVC).

9. The combination under-vehicle floor mat and parking guide according to claim 1, wherein said mat section is formed in a semi-oblong shape with a rounded back end and a squared forward end to prevent vehicles from running up over said peripheral margin while parking.

* * * * *